US006216891B1

(12) United States Patent
Kreuzer

(10) Patent No.: US 6,216,891 B1
(45) Date of Patent: Apr. 17, 2001

(54) FRAME TO RECEIVE A PART TO BE CARRIED

(75) Inventor: Friedhelm Kreuzer, München (DE)

(73) Assignee: Kreuzer GmbH & Co. OHG, Puchheim (DE)

( * ) Notice: Subject to any disclaimer, the term of this patent is extended or adjusted under 35 U.S.C. 154(b) by 0 days.

(21) Appl. No.: 09/341,977

(22) PCT Filed: Jan. 16, 1998

(86) PCT No.: PCT/EP98/00225

§ 371 Date: Jul. 16, 1999

§ 102(e) Date: Jul. 16, 1999

(87) PCT Pub. No.: WO98/31256

PCT Pub. Date: Jul. 23, 1998

(30) Foreign Application Priority Data

Jan. 17, 1997 (DE) ..... 197 01 477

(51) Int. Cl.[7] ..... A47F 5/14
(52) U.S. Cl. ..... 211/182; 211/187
(58) Field of Search ..... 211/182, 187, 211/190, 193; 248/245, 250; 108/108

(56) References Cited

U.S. PATENT DOCUMENTS 3,082,711 * 3/1963 Vetere ..... 248/245
4,753,354 * 6/1988 Patterson et al. ..... 211/182 X
4,895,331 1/1990 Nehls ..... 248/245
5,154,385 * 10/1992 Lindberg et al. ..... 248/245 X

FOREIGN PATENT DOCUMENTS 31 02 973 A1 8/1982 (DE) .
93 06 714 10/1994 (DE) .
0 166 095 1/1986 (EP) .
1138757 1/1969 (GB) .

* cited by examiner

*Primary Examiner*—Ramon O. Ramirez
(74) *Attorney, Agent, or Firm*—Dike Bronstein, Roberts & Cushman LLP; George W. Neuner

(57) ABSTRACT

A rack for receiving an object to be supported is disclosed. The rack has a pair of parallel corner profiles (1) each having two legs (2, 3) connected at an angle along an edge. A groove (4) extends parallel to the edge and has a longitudinal portion (5) which extends through the edge and which is inclined with respect to the two legs (2, 3). It also has a transverse portion (6) formed at the base of the longitudinal portion (5) and extending to both sides thereof with respective first and second portions (13, 13'). Bolts (44) engage each of the longitudinal portions (5) of the grooves (4). Sliding blocks (20) positioned in the transverse portions (6) cooperate with the bolts for fastening the object to be supported to the frame. The sliding blocks (20) each having a first region (27) and a second region (27') being in contact with respective ones of the two portions (13, 13'), wherein the two portions (13, 13') of the transverse portion (6) and the contacting two regions (27, 27') of the sliding block (20) are both inclined towards each other so as to produce a formfit connection between the sliding block (20) and the transverse portion (6).

4 Claims, 2 Drawing Sheets

FRAME TO RECEIVE A PART TO BE CARRIED

CROSS-REFERENCES TO RELATED APPLICATIONS

Not Applicable.

BACKGROUND OF THE INVENTION

1. Field of the Invention

The present invention relates to a rack for supporting an object.

2. Description of Related Art

A rack of this kind is disclosed in EP 0 166 095.

It is the object of the invention to form such a rack for supporting an object so as to enhance the load-bearing capacity thereof.

BRIEF SUMMARY OF THE INVENTION

This object is achieved by a rack comprising a pair of parallel corner profiles (1) each having two legs (2, 3) connected at an angle along an edge, a groove (4) extending parallel to the edge and having a longitudinal portion (5) which extends through the edge and which is inclined with respect to the two legs (2, 3) and a transverse portion (6) formed at the base of the longitudinal portion (5) and extending to both sides thereof with respective first and second portions (13, 13'), bolts (44) engaging each of the longitudinal portions (5) of the grooves (4) and sliding blocks (20) positioned in the transverse portions (6) and cooperating with the bolts for fastening the object to be supported to the frame, the sliding blocks (20) each having a first region (27) and a second region (27') being in contact with respective ones of the two portions (13, 13'), characterized in that the two portions (13, 13') of the transverse portion (6) and the contacting two regions (27, 27') of the sliding block (20) are both inclined towards each other so as to produce a formfit connection between the sliding block (20) and the transverse portion (6).

Advantageously, the two legs of the corner profile do nto bend up even under high loads because the form-fit produced between both portions of the groove and the corresponding regions of the sliding block cooperates in stabilizing the connection.

Embodiments will be described with reference to the Figures.

DETAILED DESCRIPTION OF THE INVENTION

Figure 1:
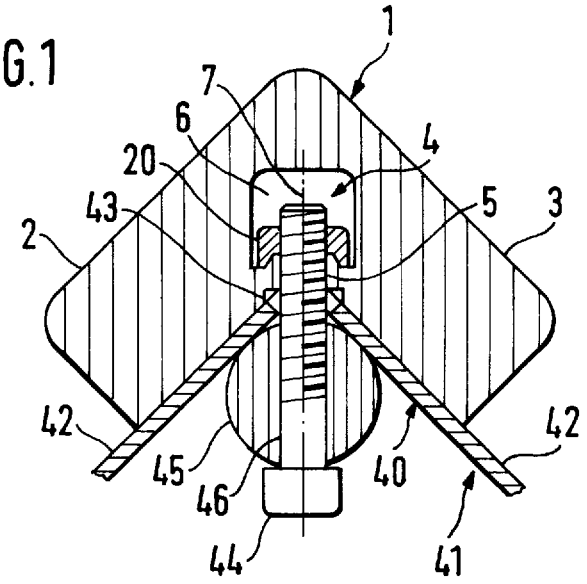
FIG. 1 shows a cross-section of a corner profile and of a part of a support platform mounted thereto.

As shown in FIG. 1, an elongate corner profile 1 comprises two legs 2, 3. A groove 4 extends in longitudinal direction of a corner profile 1 at the inner corner thereof. The groove 4 is formed by a longitudinal portion 5 extending through the inner corner of the corner profile 1 and being inclined with respect to the two legs 2, 3, and of a transverse portion 6 extending transversely to the longitudinal portion at a base thereof. The longitudinal portion 5 includes an angle of about 45° with each of the two legs 2, 3, and the transverse portion 6 includes an angle of about 90° with the longitudinal portion 5. The transverse portion 6 is symmetrically formed and arranged with respect to a center plane 7 of the longitudinal portion 5 extending in longitudinal direction.

Figure 2:
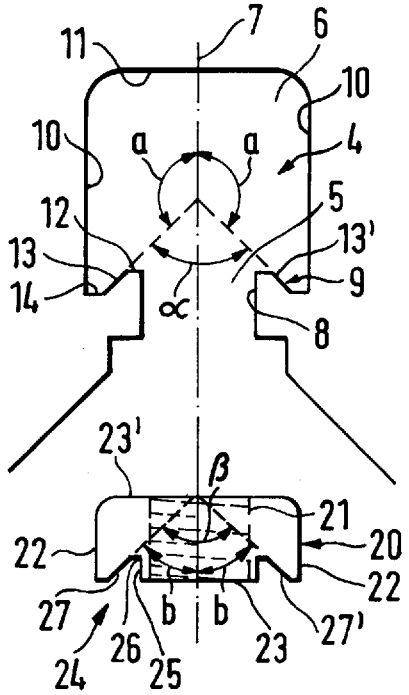
FIG. 2 shows a cross-section of a groove and a sliding block.

As shown in FIG. 2, the longitudinal portion 5 is defined by two first side walls 8. The transverse portion 6 is defined by front walls 9 contiguous with the first side walls 8, second side walls 10 contiguous with the front walls 9 and a back wall 11 connecting the two second side walls 10. Each front wall 9 comprises a first wall portion 12, which is contiguous with the corresponding first side wall 8 and extends perpendicular to the center plane 7. The first wall portions are followed by a first portion 13 and a second portion 13 each facing away from the center plane 7 and including therewith an angle a of about 135°. Hence, the two portions 13, 13' include an angle $\alpha$ of about 90°, viewing towards the longitudinal portion 5. The first portions 13, 13' are each followed by a second wall portion 14 extending perpendicular to the center plane 7 up to the corresponding second side wall 10.

As shown in FIG. 2, a sliding block 20 is arranged within the groove 4. The sliding block 20 is symmetric with respect to the center plane 7. FIG. 2 shows the sliding block 20 as a screw nut removed from the groove 4. As shown in FIG. 2, the sliding block 20 is substantially formed as a right parallel epiped and comprises two side faces 22, a bottom face 23, a top face 23' and a front and back face. An internal screw tread 21 extends in the center of the sliding block parallel to the center plane 7 from the bottom face 23 to the top face 23'. The width of the transverse portion 6 of the groove 4 slightly exceeds the width of the sliding block 20 such that the sliding block 20 can easily slide along the groove 4 in longitudinal direction thereof. The depth of the transverse portion 6 and the groove 4 exceeds the height of the sliding block 20. Two spaced parallel channel-shaped recesses 24 are formed in the bottom face 23 of the sliding block 20. Each recess 24 is defined by a first surface 25 oriented parallel to the center plane 7, a second surface 26 contiguous with the first surface 25 at a right angle thereto and a first and second region 27, 27', respectively, contiguous thereto and each including an angle $\beta$ of about 45° with the center plane 7. The two regions 27, 27' therefore include an angle $\beta$ of about 90°, viewing towards the longitudinal portion 5. The maximum spacing of the two regions 27, 27' in a direction perpendicular to the center plane 7 is smaller than the maximum distance between the two portions 13, 13' in direction perpendicular to the center plane 7 and greater than the minimum distance between the two portions 13, 13' in direction perpendicular to the center plane 7. The angles a and b are chosen to add up to substantially 180°. Thus, the angles $\alpha$ and $\beta$ are substantially equal. This ensures a surface contact between the two portions 13, 13' and the two regions 27, 27' resting thereon when assembled. The top face 23' is rounded so as to allow the sliding block 20 to be easily inserted into the groove 4 at any position.

As shown in FIG. 1, a mounting portion 40 of a support platform 41 comprises a corner having two perpendicular walls 42. A bore 43 is provided in the corner of the walls 42 for passing a bolt 44 therethrough. A round rod 45 having a bore or slot 46 is arranged in the corner between the walls 42. The cross-section of the round rod 45 contacts each wall 42 at a respective contact point.

In operation, the sliding block 20 is inserted transversely into the groove 4 at a desired place in such a way that the two regions 27, 27' extend substantially parallel to the two portions 13, 13'. This can easily be done because the depth of the groove 4 is greater than the height of the sliding block 20 and the top face 23' is rounded. Thereafter, the bolt 44 is passed through the bore or the slot 46 of the round rod 45, the bore 43 and the longitudinal portion 5 and screwed into the internal screw thread 21 of the sliding block 20. This causes the walls 42 to contact the legs 2, 3 and the two regions 27, 27' to core into surface contact with the two portions 13, 13'. Hence, a force acts towards the center plane 7 and counteracts a tendency of the legs 2, 3 of the corner profile to be bent apart which considerably stabilizes the corner profile 1. The round rod 45 causes the suspension fores to be uniformly apportioned to both walls 42 and therefore to both legs 2, 3.

It is essential that the two portions 13, 13' are oriented relative to the longitudinal portion 5 such that using an adapted sliding block 20 a force oriented towards the longitudinal portion 5 is produced in assembled state and that at the same time the two portions 13, 13' are non-positively interconnected.

Figure 3:
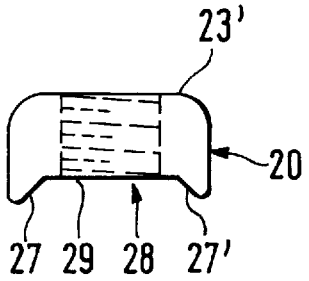
FIG. 3 shows a cross-section of a sliding block.

In an embodiment shown in FIG. 3, the sliding block 20 comprises a single recess 28 which is defined by a rear surface 29 arranged perpendicular to the center plane 7 and two laterally adjacent regions 27, 27'.

In an alternative embodiment, the sliding block 20 may comprise the recesses 24 or the recess 28 in the bottom face 23 as well as in the top face 23'. This facilitates assembling the rack because it is not necessary to pay attention to an orientation of the bottom face 23 towards the front walls 9 when inserting the sliding block 20 into the groove.

Figure 4A:
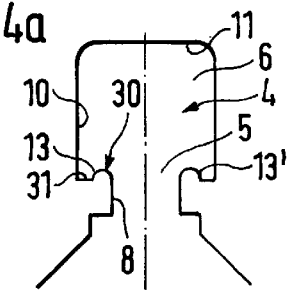
FIG. 4*a* shows a cross-section of a groove.
Figure 4B:
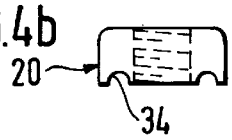
FIGS. 4*b*–4*d* show cross-sections of three different sliding blocks.

In an embodiment shown in FIG. 4*a*, the front wall 9 is shaped as a cylinder segment 30 in a direction transversely to the longitudinal direction of the groove, the cylinder segment 30 being directly contiguous with the first side wall 8. The cylinder segment 30 is connected with the second side wall 10 by a third wall portion 31 extending perpendicular to the center plane 7. The portion of the cylinder segment 30 oriented away from the center plane 7 forms a first and a second portion 13, 13'. The matching sliding block 20 comprises, as shown in FIG. 4*b*, two hollow cylinder segments 34 formed in the bottom face 23 in a direction transversely to the center plane and matching the cylinder segments. The cylinder segments 30 and hollow cylinder segments 34 are formed as regular cylinder segments. The radius of the cylinder segments 30 and their distance correspond substantially to the radius of the hollow cylinder segments 34 and their distance, respectively.

Figure 4C:
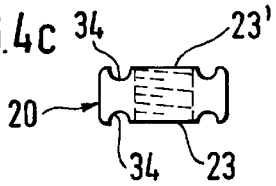
Figure 4D:
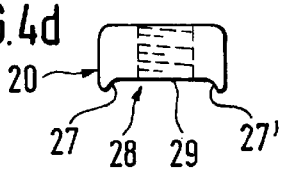

In a further embodiment shown in FIG. 4*d*, the sliding block 20 comprises a single recess 28 which is defined by a rear surface 29 and first and second regions 27, 27' contiguous therewith. The curvature of the two regions 27, 27' and their distance correspond to the curvature of the two portions 13, 13' and the distance therebetween. Alternatively, the bottom face 23 as well as the top face 23' may comprise the recess 28 or the two hollow cylinder segments 34, as shown in FIG. 4*c*.

Figure 5A:
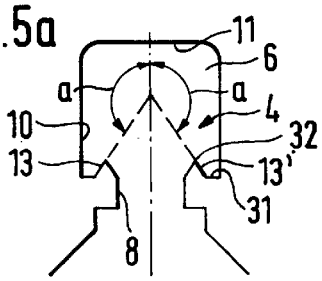
FIG. 5*a* shows a cross-section of a groove.
Figure 5B:
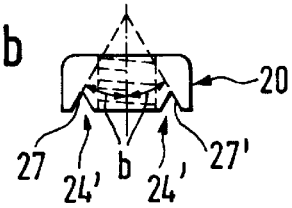
FIGS. 5*b*–5*d* show cross-sections of three different sliding blocks.

The embodiment shown in FIG. 5*a* comprises a fourth wall portion 32 instead of the cylinder segment 30 shown in FIG. 4. The fourth wall portion 32 is formed as an isosceles triangle. In this embodiment, the legs of the fourth wall portion 32 adjacent to the corresponding third wall portion 31 form the first and second portion 13, 13'. The two portiosn 13, 13' include an angle a of about 120° with the center plane 7. As shown in FIG. 5*b*, the sliding block 20 comprises two triangular recesses 24'. The recesses 24' each have a first and second region 27, 27' oriented towards the center plane 7 and including an angle b of about 60° with the center plane.

Figure 5C:
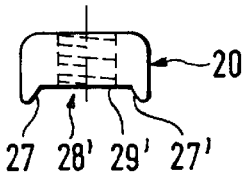
Figure 5D:
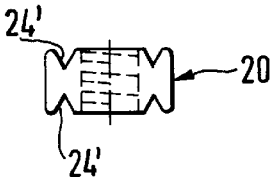

In a further embodiment shown in FIG. 5*c*, the sliding block 20 has a single recess 28' which is defined by a rear wall 29' and two regions 27, 27' adjacent thereto. Alternatively, both the bottom face 23 and the top face 23' of the sliding block 20 may comprise the single recess 28 or the two recesses 24', as shown in FIG. 5*d*.

Although the transverse portion 6 and the sliding block 20 have been described as being symmetric with respect to the center plane 7, this is not essential but the transverse portion 6 and the sliding block 20 may also be asymmetric with respect to the center plane 7.

Preferably the angle a is in a range of 110° to 160° and the angle b is in a range of 70°–20°. The angles a and b are chosen so as to add up to a value of substantially 180°. The angles $\alpha$ and $\beta$ are therefore preferably in a range of 20°–70°.

Figure 6:
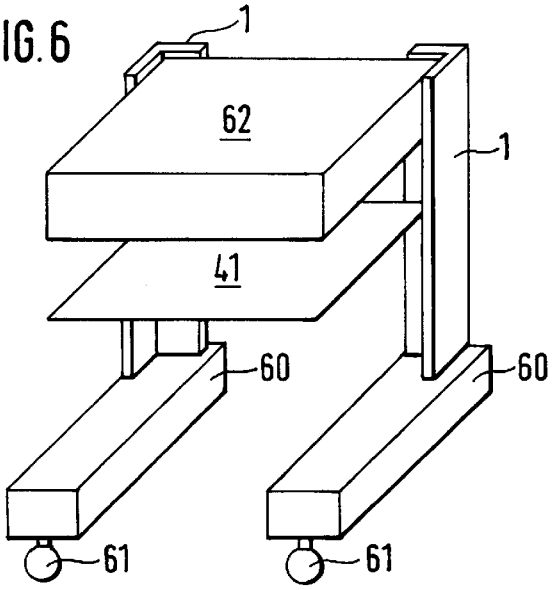
FIG. 6 is a perspective representation of an inventive rack.

FIG. 6 shows an example of an application of the inventive rack. The two corner profiles 1 are mounted on two sustainers 60 each having rollers 61 screwed thereto. The support platform 41 and a drawer 62 are attached to the two corner profiles 1 by means of any of the sliding blocks 20 shown in the FIGS. 1–5 inserted into a matching groove 4. Due to the high stability no sway bracing between the corner profiles 1 is required.

The corner profiles can be formed as extruded profiles consisting for example of aluminum.

Figure 7:
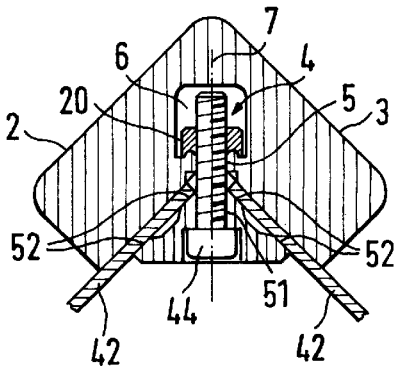
FIG. 7 shows a cross-section of a corner profile and of a part of a support platform mounted thereto according to a further embodiment.

A further embodiment is shown in FIG. 7. The embodiment shown in FIG. 7 differs from that of FIG. 1 in that the groove 4 shown in FIG. 4 and the sliding block 20 shown in FIG. 4*a* are provided within the corner profile 1 and that the round rod 45 is replaced by a wedge 50. The wedge 50 comprises a bore 51 receiving the bolt 44. The sides 52 of the wedge 50 facing the walls 42 sit close to the walls 42.

The grooves 4 and sliding blocks 20 shown in FIGS. 1 to 5 effect a non-positive interlocking connection between the two portions of the transverse portions 6 and the two contacting regions of the sliding blocks 20 which stiffens the entire profile.

What is claimed is:

1. A frame for supporting an object, the frame comprising:

a pair of parallel corner profiles each having two legs forming an angle along an inner edge of said profile, a groove extending parallel to said inner edge, said groove having a longitudinal portion extending to a base through said inner edge at an angle with respect to said legs, and a transverse portion formed at said base of said longitudinal portion, bolts extending into said longitudinal portions of said grooves, sliding blocks positioned within said transverse portions and cooperating with said bolts for attaching an object to be supported to said frame, and means for effecting a form-fit connection between said sliding blocks and said transverse portions, said means comprising first and second inclined sections of said transverse portions extending on respective sides of said longitudinal portions, and corresponding first and second inclined regions formed at said sliding blocks for contact with a respective one of said first and second inclined sections of said transverse portions of said groove.

2. The frame of claim 1, wherein said first and second inclined sections and said first and second inclined regions include an angle of less than 180°, viewing towards said longitudinal portion.

3. The frame of claim 1, wherein at least one of said first and second inclined sections has a cylinder segment shape in a direction transversely to the longitudinal direction of said groove, and the corresponding one of said first and second inclined regions is shaped as a hollow cylinder segment in a direction transverse to said longitudinal direction of said groove.

4. The frame of claim 1, further comprising a member provided at the head side of a bolt opposite to said base, said member having sides for contacting said legs or walls of said object to be supported sitting close to said legs.

* * * * *